US008597081B2

(12) United States Patent
Choi et al.

(10) Patent No.: US 8,597,081 B2
(45) Date of Patent: Dec. 3, 2013

(54) CHEMICAL MECHANICAL POLISHING APPARATUS HAVING PAD CONDITIONING DISK AND PRE-CONDITIONER UNIT

(75) Inventors: Jae-Kwang Choi, Suwon-si (KR); Hong-Jin Kim, Seoul (KR); Keon-Sik Seo, Suwon-si (KR); Sol Han, Gyeonggi-do (KR); Kun-Tack Lee, Suwon-si (KR); Byoung-Ho Kwon, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 258 days.

(21) Appl. No.: 13/241,421

(22) Filed: Sep. 23, 2011

(65) Prior Publication Data

US 2012/0083189 A1 Apr. 5, 2012

(30) Foreign Application Priority Data

Oct. 5, 2010 (KR) ..... 10-2010-0096858

(51) Int. Cl.
*B24B 1/00* (2006.01)

(52) U.S. Cl.
USPC ..... 451/56; 451/72; 451/443; 451/446; 451/402; 451/548

(58) Field of Classification Search
USPC ..... 451/41, 443, 446, 402, 56, 72, 539, 451/548–551
See application file for complete search history.

(56) References Cited

U.S. PATENT DOCUMENTS

| | | | | |
|---|---|---|---|---|
| 4,114,322 | A * | 9/1978 | Greenspan | 451/541 |
| 5,626,509 | A * | 5/1997 | Hayashi | 451/285 |
| 6,302,771 | B1 * | 10/2001 | Liu et al. | 451/56 |
| 6,419,574 | B1 * | 7/2002 | Takahashi et al. | 451/548 |
| 6,439,986 | B1 * | 8/2002 | Myoung et al. | 451/443 |
| 7,021,995 | B2 * | 4/2006 | Toge et al. | 451/56 |
| 7,235,114 | B1 * | 6/2007 | Minick et al. | 51/295 |
| 2001/0009844 | A1 * | 7/2001 | Cho et al. | 451/443 |
| 2009/0090066 | A1 | 4/2009 | Chen | |
| 2011/0244763 | A1 * | 10/2011 | Yuan et al. | 451/56 |

FOREIGN PATENT DOCUMENTS

| | | |
|---|---|---|
| JP | 2008-080480 | 4/2008 |
| KR | 1020070069915 | 7/2007 |
| KR | 1020080061716 | 7/2008 |

* cited by examiner

*Primary Examiner* — George Nguyen
(74) *Attorney, Agent, or Firm* — F. Chau & Associates, LLC

(57) ABSTRACT

A pad conditioning disk, a pre-conditioning unit, and a CMP apparatus having the same are provided. The pad conditioning disk includes a base in which mountain-type tips and valley-type grooves are repeatedly connected to each other, and a cutting layer formed on the base layer. The cutting layer including conditioning particles deposited on surfaces of the tips and grooves. A surfaces roughness of conditioning particles deposited on the surfaces of the tips is less than a surface roughness of conditioning particles deposited on the surfaces of the grooves.

20 Claims, 6 Drawing Sheets

CHEMICAL MECHANICAL POLISHING APPARATUS HAVING PAD CONDITIONING DISK AND PRE-CONDITIONER UNIT

CROSS-REFERENCE TO RELATED APPLICATION

This application claims priority under 35 U.S.C. §119 to Korean Patent Application No. 10-2010-0096858 filed on Oct. 5, 2010, the disclosure of which is hereby incorporated by reference in its entirety.

BACKGROUND

1. Technical Field

Exemplary embodiments of the inventive concept relate to a pad conditioning disk, a pre-conditioner unit, and a chemical mechanical polishing apparatus having the same.

2. Description of Related Art

In a planarization process using a chemical mechanical polishing (CMP) apparatus, the profile of a polishing pad installed in the CMP apparatus may be a significant variable having a significant effect on a flatness characteristic of the surface of a wafer to be abraded. Thus, to actively carry out a wafer planarization process using the CMP apparatus, the profile of the polishing pad should be continuously maintained in a state suitable for the process like an initial state.

However, in a planarization process using the CMP apparatus, the polishing pad may have a slurry or other impurities or may be damaged during the continuous polishing process. The profile of the polishing pad may be deformed into a state different from the initial state, which in turn may cause a reduction in stability of the wafer planarization process.

Accordingly, various kinds of pad conditioner units and pad conditioning methods using the same capable of stablizing the profile of the polishing pad when the wafer planarization process is continuously carried out using the CMP apparatus have been suggested.

SUMMARY

Exemplary embodiments of the inventive concept provide a pad conditioning disk.

Exemplary embodiments of the inventive concept also provide a pre-conditioner unit.

Exemplary embodiments of the inventive concept also provide a CMP apparatus.

Exemplary embodiments of the inventive concept also provide a method of pre-conditioning a pad conditioning disk.

The inventive concept is not limited to the above-mentioned exemplary embodiments, and other exemplary embodiments which are not be described will be clearly understood with reference to the following descriptions by those skilled in the art.

In accordance with an exemplary embodiment of the inventive concept, a pad conditioning disk includes a base in which mountain-type tips and valley-type grooves are repeatedly connected to each other, and a cutting layer formed on the base layer. The cutting layer includes conditioning particles are deposited on surfaces of the tips and grooves. Here, the conditioning particles deposited on the surfaces of the tips may have a surface roughness less than a surface roughness of the conditioning particles deposited on the surfaces of the grooves.

In accordance with an exemplary embodiment of the inventive concept, a CMP apparatus includes a pad conditioning disk in which diamond particles are adhered to its surface, and a sacrificial pad controlling a surface roughness of the diamond particles.

In accordance with an exemplary embodiment of the inventive concept, a CMP apparatus includes a first pad, to which a first slurry is supplied, performing a conditioning process through mechanical abrasion with a pad conditioning disk while maintaining contact and friction with the pad conditioning disk, and a second pad, to which a second slurry is supplied, performing a disk conditioning process through mechanical abrasion with the pad conditioning disk while maintaining contact and friction with the pad conditioning disk.

In accordance with an exemplary embodiment of the inventive concept, a pre-conditioner unit includes a disk conditioning turntable, a sacrificial pad installed on the disk conditioning turntable and previously conditioning a pad conditioning disk on which diamond particles are deposited, and a disk slurry supply unit supplying a disk slurry on the sacrificial pad.

In accordance with an exemplary embodiment of the invention concept, a chemical mechanical polishing (CMP) apparatus includes a polishing head configured to hold and rotate a wafer and a polishing station for polishing the wafer. The polishing station including a polishing turntable which is rotatable, a polishing pad mounted on a top surface of the polishing turntable, and the polishing pad is configured to planarize the wafer by mechanical abrasion when in contact therewith. The polishing station further includes a pad conditioner unit for cutting or abrading a surface of the polishing pad. The pad conditioner unit includes a pad conditioning holder movable in a vertical direction and rotatable, and a pad conditioning disk including a base adhered to the pad conditioning holder and a cutting layer formed on the base. The base includes mountain-type tips having inclined sidewalls and projecting from the base and valley-type grooves depressed between the tips, and the tips and grooves are repeatedly arranged and connected to each other, and a cutting layer formed on the base. The cutting layer includes conditioning particles adhered to a surface of the tips and the grooves with at least some of the conditioning particles have differing surface heights from one another. In addition, the polishing station includes a first slurry supply unit configured to supply a pad slurry including abrasive particles composed of at least one of silica, alumina, and ceria to a top surface of the polishing pad during at least one of the wafer polishing process or a pad conditioning process. Moreover, the CMP apparatus further includes a pre-conditioner unit for pre-processing the pad conditioning disk. The pre-conditioner unit includes a disk conditioning turntable which is rotatable, a sacrificial pad mounted on a top surface of the disk conditioning turntable, and a second slurry supply unit configured to supply a disk slurry including abrasive particles composed of at least one of silica, alumina, and ceria on the sacrificial pad.

BRIEF DESCRIPTION OF THE DRAWINGS

In the accompanying drawings, like reference characters refer to the same parts throughout the different views. In addition, the drawings are not necessarily to scale Also, exemplary embodiments of the inventive concept can be understood in further detail from the following description taken in conjunction with the accompanying drawings in which.

DETAILED DESCRIPTION OF EXEMPLARY EMBODIMENTS

Figure 1:
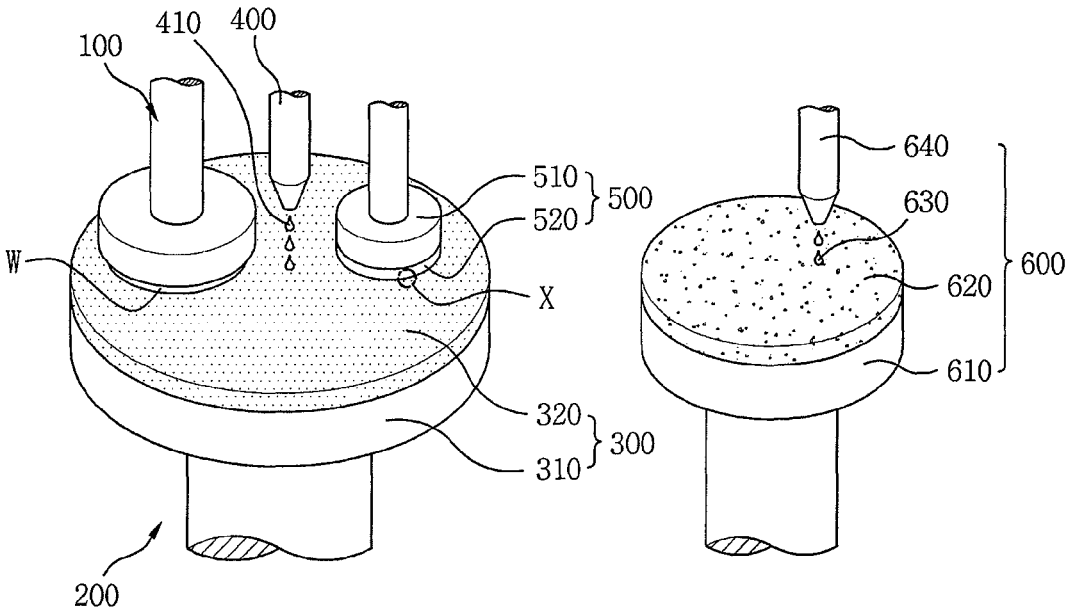
FIG. 1 is a partial perspective view schematically showing a CMP apparatus according to an exemplary embodiment of the inventive concept.

Various embodiments will now be described more fully with reference to the accompanying drawings in which some exemplary embodiments are shown. These inventive concepts may, however, be embodied in different forms and should not be construed as limited to exemplary embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. Like numerals refer to like elements throughout. As used herein, the term "and/or" includes any and all combinations of one or more of the associated listed items.

Figure 2:
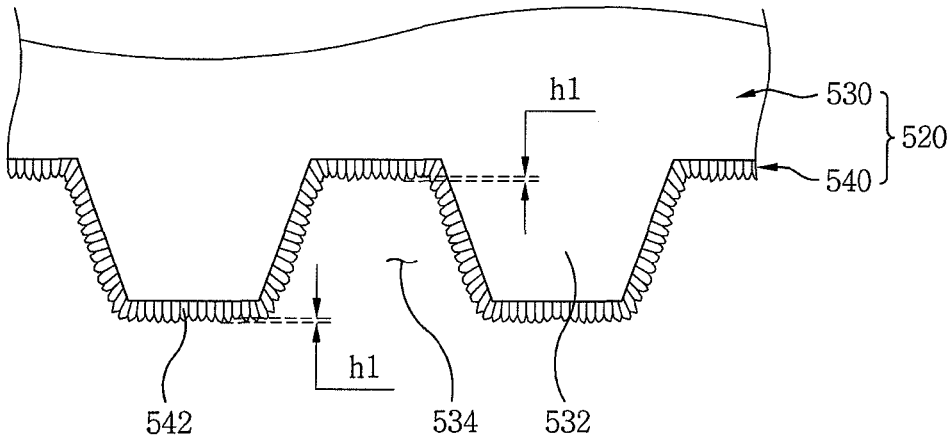
FIG. 2 is a partially-enlarged cross-sectional view of part "X" of FIG. 1 to show a pad conditioning disk according to an exemplary embodiment of the inventive concept.

FIG. 1 is a partial perspective view schematically showing a CMP apparatus according to an exemplary embodiment of the inventive concept, and FIG. 2 is a partially-enlarged cross-sectional view of part "X" of FIG. 1.

Referring to FIG. 1, the CMP apparatus according to an exemplary embodiment of the inventive concept may include, for example, a polishing head 100 holding a wafer W and a polishing station 200 planarizing the wafer W.

The polishing head 100 may hold the wafer W using, for example, a vacuum adsorbing method. The polishing head 100 may press or rotate the held wafer W during a wafer polishing process.

The polishing station 200 may include, for example, a platen unit 300, a pad slurry supply unit 400 and a pad conditioner unit 500.

The platen unit 300 may include, for example, a polishing turntable 310, and a polishing pad 320 mounted on a top surface of the polishing turntable 310. The polishing turntable 310 may be rotatable.

The polishing turntable 310 may be formed in, for example, a round shape. The polishing turntable 310 may be rotated at a regular speed during a wafer polishing process or pad conditioning process. The polishing pad 320 may include, for example, a polyurethane pad.

The pad slurry supply unit 400 may be installed on the polishing pad 320. The pad slurry supply unit 400 may include, for example, a pad slurry supply nozzle supplying a pad slurry 410 to a top surface of the polishing pad 320 during the wafer polishing process. The pad slurry 410 may include, for example, an oxidizing agent, a hydroxidizing agent, abrasive particles, a surfactant, a dispersing agent, and other catalyzing agents. The pad slurry 410 may chemically change a surface of the wafer W, and mechanically abrade the wafer W. The abrasive particles included in the pad slurry 410 may mechanically polish the wafer W. The abrasive particles may include at least one selected from, for example, silica, alumina or ceria particles.

The pad conditioner unit 500 may include, for example, a pad conditioning holder 510 and a pad conditioning disk 520. The pad conditioner unit 500 may be installed on the periphery of the polishing head 100. The pad conditioner unit 500 may increase, for example, a surface state of the polishing pad 320 during the pad conditioning process, and maintain it as an initial state. In the initial state, a surface roughness of the polishing pad 320 may be maintained at an arithmetic mean variation of, for example, approximately 4 to 6 μm, and the state of the polishing pad 320 may be stable and optimized at a surface roughness of approximately 5 μm. The pad slurry 410 supplied for the wafer polishing process may also be used to perform a pad conditioning process. Alternatively, a separate slurry may be supplied for pad conditioning process. In this case, the pad slurry supply unit 400 may be installed in the pad conditioner unit 500, and the separate slurry may be supplied by the pad conditioner unit 500.

The pad conditioning holder 510 may be formed in, for example, a round plate shape, and vertically move or rotate. The pad conditioning holder 510 may be pressed in a vertical direction using, for example, a pneumatic or hydraulic cylinder or rotated using a spindle. The pad conditioning holder 510 may stand by in a home area, and then may be transferred to an upper portion of the polishing pad 320 by a moving unit when the wafer polishing process or pad conditioning process is progressed.

Referring to FIG. 2, the pad conditioning disk 520 may be formed in, for example, a round plate shape like the pad conditioning holder 510. The pad conditioning disk 520 may include, for example, a base 530 adhered to the pad conditioning holder 510, and a cutting layer 540 formed on the base 530 and abrading the polishing pad 320.

The base 530 may be formed of, for example, a ceramic or silicon material. The base 530 may include, for example, mountain-type tips 532 projecting from the base 530, and valley-type grooves 534 depressed between the tips 532. The tips 532 and the grooves 534 may be, for example, repeatedly arranged. The grooves 534 may be arranged in, for example, a mesh or lattice type, which is extended in vertical or horizontal directions. The tips 532 may be formed in, for example, a pillar or mesa type, which is defined by the mesh- or lattice-type grooves 534. Sidewalls of the tips 532 may be, for example. inclined. Therefore, the plurality of pillar- or mesa-type tips 532 having a lower cross-section smaller than an upper cross-section may be arranged in, for example, a matrix type between the grooves 534. The grooves 534 may be used as pathways supplying the pad slurry 410. Alternatively, the grooves 534 may be pathways to exhaust a cut product of the polishing pad 320, that is, a byproduct of the pad conditioning process.

The cutting layer 540 may include, for example, conditioning particles adhered to surfaces of the tips 532 and the grooves 534. The conditioning particles may include, for example, diamond particles 542 or sapphire particles. The diamond particles 542 may include artificial or natural diamonds. The diamond particles 542 may be adhered onto a surface of the base 530 using, for example, a chemical vapor deposition (CVD) method. The diamond particles 542 may be adhered to surfaces of the tips 532 and the grooves 534.

Since the diamond particles 542 adhered to the surfaces of the tips 532 and the grooves 534 do not have uniform sizes but are in a diameter of approximately 15 to 25 μm, the grooves 534 do not have uniform sizes but are in a diameter of approximately 15 to 25 μm, the diamond particles 542 may have non-uniform surface heights. As a result, there is a deviation between the surface heights of the diamond particles 542, and thus the surfaces to which the diamond particles are adhered are roughened and have an ability to cut or abrade the polishing pad 320. That is, the surface roughness of the diamond particles 542 may be expressed as a deviation or mean between the maximum and minimum heights of the surfaces of the diamond particles 542 having different sizes. The deviation h1 or mean of the surface heights of the diamond particles 542 adhered to the surfaces of the tips 532 and the grooves 534 may have an average of, for example, about 2.0 μm or less.

The pad conditioner unit 500 may serve to restore the profile of the polishing pad 320 to the initial state using the diamond particles 542 adhered to the surfaces of the tips 532. For example, in the pad conditioner unit 500, the profile of the polishing pad 320 pressed and cracked by the wafer polishing process can become rough. It is possible to make the surface of the polishing pad 320 rough in the state that the diamond particles 542 are in contact with the polishing pad 320.

Referring again to FIG. 1, the CMP apparatus of an exemplary embodiment of the inventive concept may include a pre-conditioner unit 600 for pre-processing the pad conditioning disk 520.

The pre-conditioner unit 600 may include, for example, a disk conditioning turntable 610, and a sacrificial pad 620 mounted on a top surface of the disk conditioning turntable 610. The disk conditioning turntable 610 may be formed in, for example, a round plate shape and rotated. The pre-conditioner unit 600 may further include, for example, a disk slurry supply unit 640 supplying a disk slurry 630 on the sacrificial pad 620. The disk slurry supply unit 640 may include, for example, a slurry supply nozzle spraying the disk slurry 630.

When the pad conditioner unit 500 serves to optimize the profile of the polishing pad 320 in the relationship with the platen unit 300, the pre-conditioner unit 600 may serve to optimize an exposed state of the diamond particles 542 in the relationship with the pad conditioner unit 500. For example, due to the arrangement and shape of the diamond particles 542, the profile of the polishing pad 320 may be changed, and a pad conditioning effect may differ. Thus, the pre-conditioner unit 600 is provided to increase a non-uniform degree of exposure (or roughness) of the diamond particles 542, e.g., the arrangement or shape of the diamond particles 542, through the disk conditioning process before a pad conditioning process is performed.

Meanwhile, a deposition process of the diamond particles 542 occurs in a process chamber, and the process chamber is in a nearly vacuum state. However, the influx of particles may not be completely prevented from an external atmospheric state. For this reason, as the particles are deposited to the cutting layer 540 to which the diamond particles 542 are adhered, the deviation h1 of the surface heights of the diamond particles 542 may be increased. Therefore, due to the disk conditioning process, the roughness of the diamond particles 542 may be increased, and the particles adhered during the deposition process may be effectively removed.

Figure 3:
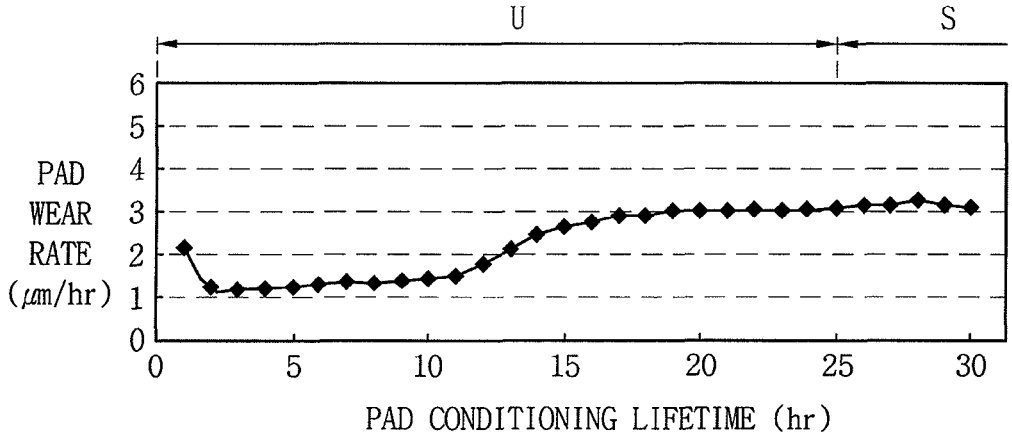
FIG. 3 is a graph showing the relationship between a pad conditioning lifetime and a wear rate of a pad according to an exemplary embodiment of the inventive concept.
Figure 4A:
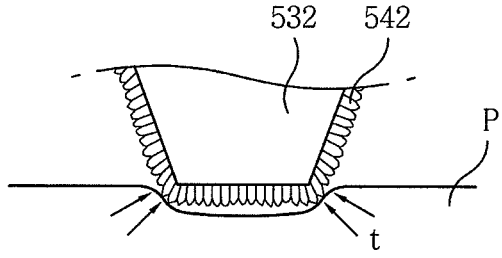
FIGS. 4A to 4C are partially-enlarged cross-sectional views showing a procedure in which the surface height of diamond particles is changed according to the pad conditioning lifetime according to an exemplary embodiment of the inventive concept.
Figure 4B:
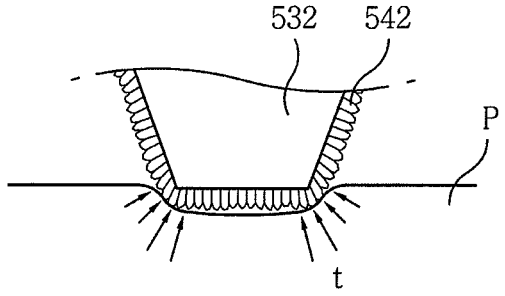
Figure 4C:
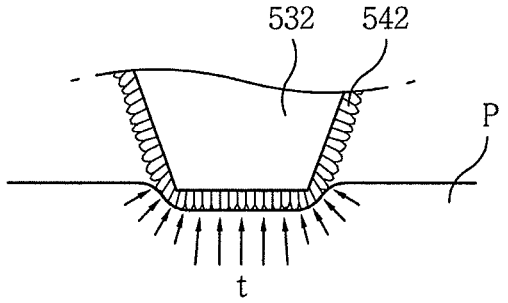

FIG. 3 is a graph showing the relationship between a pad conditioning lifetime and a pad wear rate according to an exemplary embodiment of the inventive concept, and FIGS. 4A to 4C are partially-enlarged cross-sectional views showing a procedure in which the surface height of diamond particles is changed according to the pad conditioning lifetime of FIG. 3.

Referring to FIG. 3, the pad conditioning effect may differ according to the conditioning lifetime of a polyurethane pad P abraded by the diamond particles 542. The polyurethane pad P may include, for example, the polishing pad 320 or the sacrificial pad 620. Depending on the degree of conditioning the pad, a pad wear rate (PWR; μm/hr) of the polyurethane pad P may be decreased or increased, and then stabilized after a certain time. It can be seen that when the pad conditioning process has been performed for about 12 to about 25 hours, the PWR of the polyurethane pad P becomes uniform, and the pad conditioning effect is stablized. This is because the exposure degree (or roughness) of the diamond particles 542 may be determined by the lifetime of the polyurethane pad P subjected to pad conditioning. The lifetime of the polyurethane pad P abraded by the diamond particles 542 may include a first section U in which the PWR is increased or decreased and a second section S in which the PWR is uniformly maintained.

For example, referring to FIG. 4A, as the PWR of the polyurethane pad P is instantly decreased during about 1 to about 2 hours in the first section U of FIG. 3, the diamond particles 542 deposited at an edge of the tip 532 are in contact with and subjected to friction with the polyurethane pad P, and thus the surface height of the diamond particles 542 deposited at the edge of the tip 532 may be decreased. As described above, the reasons why the polyurethane pad P is first in contact with the edge of the tip 532 are that the polyurethane pad P is formed of an elastic material and elasticity t greatly affects the polyurethane pad P that is in contact with the edge of the tip 532. Referring to FIG. 4B, as the PWR of the polyurethane pad P is gradually increased after 3 hours in the first section U of FIG. 3, the surface height of the diamond particles 542 deposited at the edge of the tip 532 is decreased, and the diamond particles 542 deposited on a bottom surface of the tip 532 are in contact with and subjected to friction with the polyurethane pad P, and thus the PWR of the polyurethane pad P may be gradually increased. Referring to FIG. 4C, as the PWR of the polyurethane pad P after the second section S of FIG. 3 becomes uniform, the surface height of the diamond particles 542 deposited on the bottom surface of the tip 532 is decreased and thus the PWR of the polyurethane pad P may be uniform.

Figure 5:
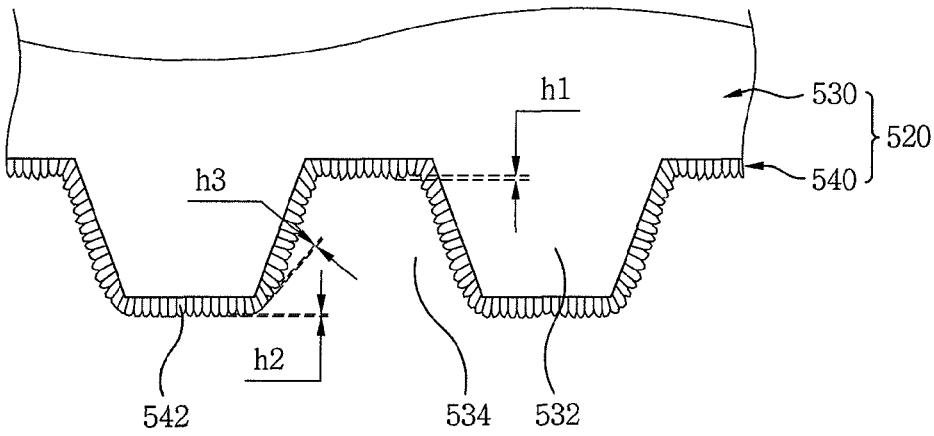
FIG. 5 is a partially-enlarged cross-sectional view showing the surface heights of diamond particles on the pad conditioning disk which has undergone a disk conditioning process according to an exemplary embodiment of the inventive concept.
Figure 6:
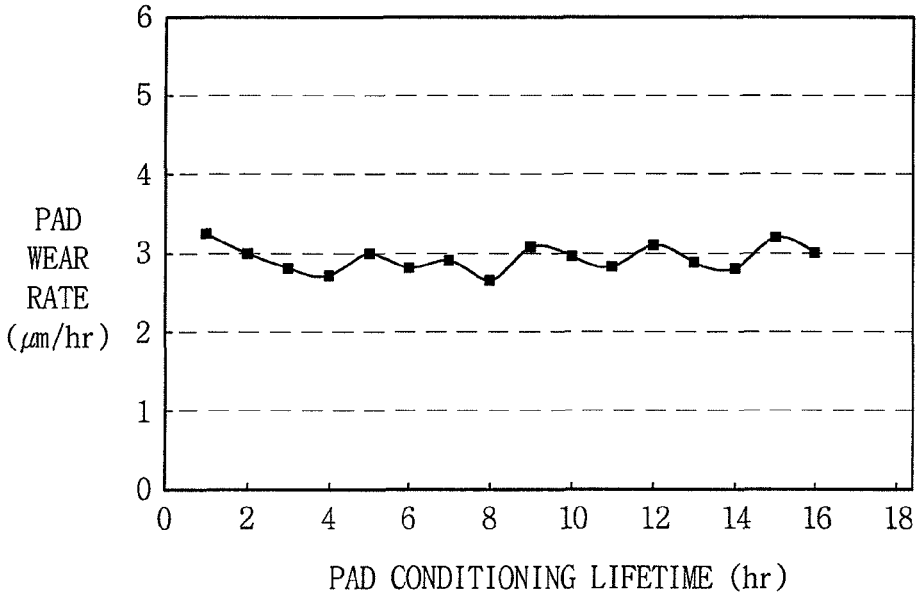
FIG. 6 is a graph showing the relationship between a pad conditioning lifetime and a pad wear rate when the pad conditioning disk which has undergone the disk conditioning process is used according to an exemplary embodiment of the inventive concept.

FIG. 5 is a partially-enlarged cross-sectional view showing surface heights of diamond particles on the pad conditioning disk which has undergone a pad disk conditioning process according to an exemplary embodiment of the inventive concept, and FIG. 6 is a graph showing the relationship between the pad conditioning lifetime and the PWR when the pad conditioning disk which has undergone the disk conditioning process of FIG. 5 is used.

Referring to FIG. 5, while the surfaces of the diamond particles 542 deposited in the grooves 534 still have a height variation h1 or mean of, for example, about 1.5 to about 2.0 μm, which is the same as that before the disk conditioning process is performed, the surfaces of the diamond particles 542 deposited on the tips 532 may have a height variation h2 or mean of, for example, about 1.5 μm or less. Therefore, the surface height variation of the diamond particles 542 deposited on the tips 532 is decreased within a certain range through the disk conditioning process, and thus the PWR of the polishing pad 320 according to the pad conditioning process may be stabilized. A surface height variation h3 of the diamond particles 542 deposited at the edges of the tips 532 may be a height variation or mean of, for example, about 1.4 μm or less, which is lower than the total mean of the tips 532.

Referring to FIG. 6, the PWR (μm/hr) of the polishing pad 320 may be stablized to be unrelated to the lifetime of the polishing pad 320. Before the pad conditioning effect of the pad conditioner unit 500 is stablized, it may be necessary to perform a disk conditioning process on the pad conditioner unit 500 using the pre-conditioner unit 600. After the pad conditioning effect is stablized, the pad conditioner unit 500 having a pad conditioning disk 520 that underwent the pad disk conditioning process according to an exemplary embodiment of the inventive concept in FIG. 5 is then applied to a CMP apparatus, which effectively restores the profile of the polishing pad 320 to the initial state as illustrated in FIG. 6.

Figure 7:
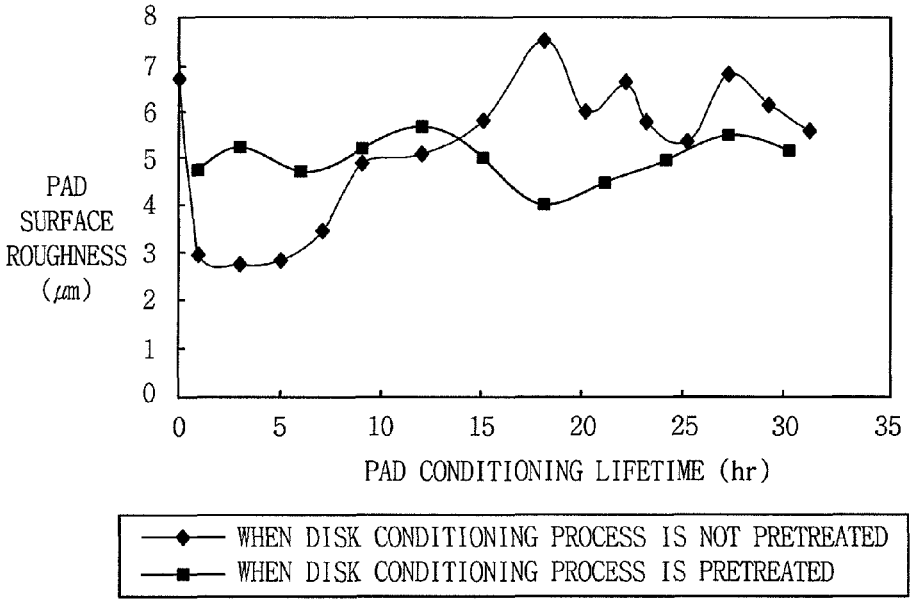
FIG. 7 is a graph showing the relationship between a pad conditioning lifetime and a pad surface roughness according to an exemplary embodiment of the inventive concept.

FIG. 7 is a graph showing the relationship between the pad conditioning lifetime and the pad surface roughness according to an exemplary embodiment of the inventive concept. When the pad conditioning process is performed without the disk conditioning process (pre-process), the polishing pad 320 is not sufficiently abraded, and thus the surface roughness of the polishing pad 320 may be decreased to about 3 μm. In addition, since the surface roughnesses of the diamond particles 542 are non-uniform, the surface roughness of the polishing pad 320 may be increased to about 8 μm. As a result, the surface roughness of the pad is non-uniform depending on the pad lifetime. However, when the pad conditioning process is performed after the disk conditioning process, the polishing pad 320 is sufficiently abraded, and thus the polishing pad 320 may maintain a constant surface roughness within a range of, for example, about 4 to about 6 μm. During the disk conditioning process, the surface roughness of the sacrificial pad 320 maybe maintained within a range of, for example, about 3 to about 8 μm.

The disk conditioning process may be performed under the same conditions as the pad conditioning process. A process of abrading the surface of the polishing pad 320 by the mechanical friction of the diamond particles 542 of the pad conditioner unit 500 with the polishing pad 320 may be the same as or similar to a process of abrading the surface of the sacrificial pad 620 by the mechanical friction of the diamond particles 542 with the sacrificial pad 620.

The disk conditioning process may be performed under different conditions from the pad conditioning process. The process of abrading the surface of the sacrificial pad 620 by the diamond particles 542 of the pad conditioner unit 500 is not performed to planarize the sacrificial pad 620, but performed to control a degree of non-uniformity of the diamond particles 542, resulting in planarization of the polishing pad 320. Therefore, this process may be different from the pad conditioning process, which directly abrades the polishing pad 320.

For example, the effect or change of the pad conditioning process or disk conditioning process in the surface of the polishing pad 320 or sacrificial pad 620 may be dependant on, for example, the kind of the pad conditioner unit 500 or pre-conditioner unit 600, the kind of the polishing pad 320 or sacrificial pad 620, the kind of the pad slurry 410 or disk slurry 630, the kind of the abrasive particles included in the pad slurry 410 or disk slurry 630, or the pressure applied to the polishing pad 320 or sacrificial pad 620 by the pad conditioning holder 510.

The sacrificial pad 620 may include, for example, a wear resistant polymer. The sacrificial pad 620 may include a pad formed of, for example, a polyurethane-impregnated non-woven fabric. The non-woven fabric may include, for example, a polyester fiber. The sacrificial pad 620 may include a pad formed by, for example, coating a porous urethane layer on a pressable polyurethane substrate.

The disk slurry 630 may include, for example, a chemical solution containing abrasive particles. The abrasive particles may include, for example, a material having great mechanical hardness and strength. The abrasive particles may include at least one selected from, for example, silica, alumina and ceria particles. The chemical solution may include, for example, deionized water, a surfactant, a dispersing agent, and an oxidizing agent. The disk slurry 630 may be present, for example, in a suspension state by dispersing abrasive particles in a chemical solution.

The concentration of the abrasive particles may be determined within a range of, for example, about 5 to about 30 wt % of the total disk slurry 630. The size of the abrasive particles may be determined within a range of, for example, about 20 to about 400 nm. The downward pressure of the pad conditioning disk 520 applied to the sacrificial pad 620 may be determined within a range of, for example, about 8 to about 20 pounds (lb). In the pad conditioning process, when an excessive pressure of about 8 lb or more is applied to the polishing pad 320 from the pad conditioning disk 520, the diamond particles 542 block the micropores, rather than restoring the micropores formed in the profile of the polishing pad 320. For this reason, it may be difficult to restore the profile of the polishing pad 320 to the initial state. However, in the disk conditioning process, even if the downward pressure of the pad conditioning disk 520 is, for example, about 8 lb or more, since the sacrificial pad 620 is only a consumable, not a subject to be restored, the object of the preprocess of the pad conditioning disk 520 may be achieved.

Hereinafter, a CMP method according to an exemplary embodiment of the inventive concept will be described.

Figure 8A:
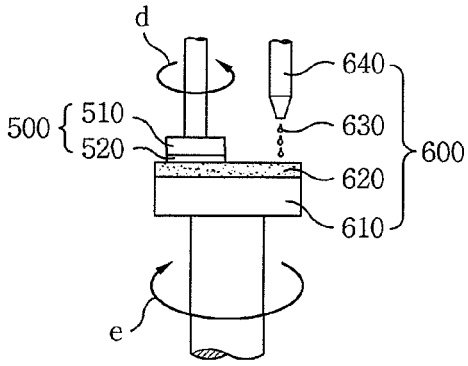
FIG. 8A is a side view of a CMP apparatus performing a disk conditioning process according to an exemplary embodiment of the inventive concept.
Figure 8B:
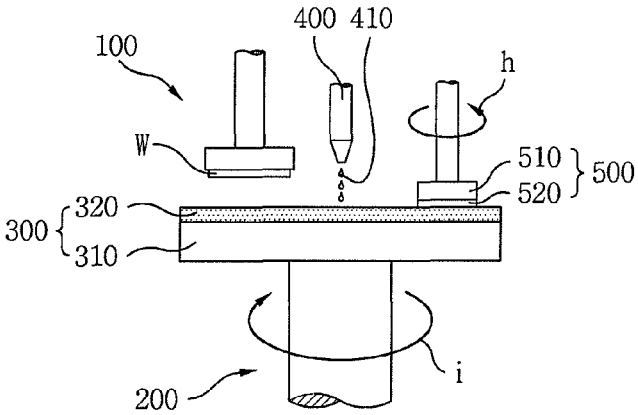
FIG. 8B is a side view of a CMP apparatus performing a pad conditioning process according to an exemplary embodiment of the inventive concept.
Figure 8C:
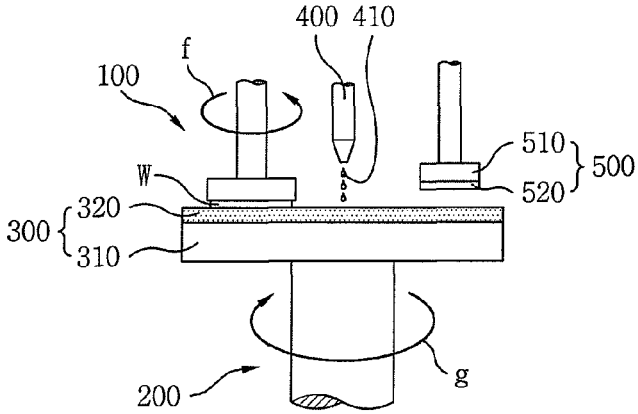
FIG. 8C is a side view of a CMP apparatus performing a wafer polishing process according to an exemplary embodiment of the inventive concept.

FIGS. 8A to 8C are side views of CMP apparatuses respectively performing a disk conditioning process, a pad conditioning process, and a wafer polishing process according to an exemplary embodiment of the inventive concept.

Referring to FIG. 8A, the disk conditioning process may be performed. The pad conditioner unit 500 may be aligned with the pre-conditioner unit 600 in a vertical direction. For example, to move the pad conditioning holder 510 toward the disk conditioning turntable 610 and closely adhere the pad conditioning disk 520 to the sacrificial pad 620, the pad conditioner unit 500 may be pressured to the pre-conditioner unit 600 by a pneumatic cylinder. While the disk conditioning process is performed, the pad conditioning holder 510 may be rotated in an opposite direction to a rotating direction of the sacrificial pad 620 as shown by arrows d and e. Alternatively, the pad conditioning holder 510 may rotate while the disk conditioning turntable 610 stops. On the other hand, the polishing head 100 may stop while the disk conditioning turntable 610 rotates. As the disk conditioning turntable 610 rotates at a regular speed (rpm), mechanical abrasion caused by friction may occur on the surface of the pad conditioning disk 520 and the surface of the sacrificial pad 620. The disk slurry 630 may be supplied on the sacrificial pad 620 by the disk slurry supply unit 640. The disk slurry 630 may flow in between the grooves 534 (of FIG. 2) formed between the projecting tips 534 (of FIG. 2). As a result, a chemical reaction may occur between the disk slurry 630 flowing in between the grooves 534 (of FIG. 2) and the sacrificial pad 620.

Referring to FIG. 8B, the pad conditioning process may be performed. When the wafer polishing process is performed, the surface of the polishing pad 320 may be pressed or a micropore in the polishing pad 320 may be blocked. As a result, the planarization of the polishing pad 320 may be changed. The planarization of the changed polishing pad 320 may be restored to the initial state through the conditioning process of cutting or abrading the surface of the changed polishing pad 320 using the pad conditioner unit 500. The pad conditioning process may be performed separately from the wafer polishing process. For example, the pad conditioning process may be performed right before or after the wafer polishing process. Alternatively, the pad conditioning process may be performed during the wafer polishing process. When the pad conditioning holder 510 is in contact with the polishing pad 320, the pad conditioning holder 510 may, for example, rotate in an opposite direction to the rotating direction of the polishing pad as shown by arrows h and i. Likewise, the pad conditioning process is performed to optimize the profile of the polishing pad 320, and the profile of the polishing pad 320 may be changed according to the surface state of the diamond particles 542 adhered to a bottom surface of the pad conditioning disk 520. As described above, since the disk conditioning process is performed before the pad conditioning process as shown in FIG. 8A, the PWR of the polishing pad 320 may be constantly maintained. Here, the disk conditioning process may be performed ex situ with the pad conditioning process. Alternatively, the disk conditioning process may be performed in situ.

Referring to FIG. 8C, the wafer polishing process may be performed. The wafer W to be abraded may be adsorbed and fixed below the polishing head 100. After the polishing head 100 is aligned with the platen unit 300, the polishing head 100 may rotate at a predetermined speed (rpm), and be in contact with the polishing pad 320. During the wafer polishing process, the polishing head 100 may, for example, rotate in an opposite direction to the rotating direction of the polishing pad 320 as shown by arrows f and g. Alternatively, while a polishing turntable 310 stops, the polishing head 100 may rotate. On the other hand, while the polishing turntable 310 rotates, the polishing head 100 may stop. For example, when the pad slurry 410 is supplied from the pad slurry supply unit 400, the surface of the wafer W may be uniformly planarized by mechanical abrasion by contact between the polishing pad 320 and the wafer W and chemical abrasion by the pad slurry 410.

When a CMP apparatus according to exemplary embodiments of the inventive concept described above is used, a surface height variation of diamond particles adhered to a pad conditioning disk is decreased, and conditioning ability becomes uniform. Therefore, a PWR of a polishing pad cut or abraded by the pad conditioning disk may be constantly maintained. In addition, since the PWR of the polishing pad is constantly maintained and the profile of the polishing pad is always maintained as an initial state, a wafer planarization process can be actively carried out.

Having described exemplary embodiments of the inventive concept, it is further noted that it is readily apparent to those of reasonable skill in the art that various modifications may be made without departing from the spirit and scope of the invention which is defined by the metes and bounds of the appended claims.

What is claimed is:

1. A pad conditioning disk, comprising:

a base in which mountain-type tips and valley-type grooves are repeatedly connected to each other; and a cutting layer formed on the base, the cutting layer including conditioning particles deposited on surfaces of the tips and the grooves, wherein the conditioning particles deposited on the surfaces of the tips have a surface roughness less than a surface roughness of the conditioning particles deposited on the surfaces of the grooves.

2. The pad conditioning disk of claim 1, wherein the conditioning particles include diamond particles.

3. The pad conditioning disk of claim 2, wherein the surface roughness of the diamond particles deposited on the surfaces of the grooves is in a range of about 1.5 to about 2.0 μm, and the surface roughness of the diamond particles deposited on the surfaces of the tips has an average of about 1.5 μm or less.

4. The pad conditioning disk of claim 3, wherein the base is formed of one of a ceramic or silicon material, the grooves are arranged in one of a mesh or lattice type extending in one of a vertical or horizontal direction, and the tips defined by the grooves are formed in one of a pillar or mesa type having a lower cross-section smaller than an upper cross-section.

5. The pad conditioning disk of claim 4, wherein a surface roughness of the diamond particles formed at edges of the tips is less than the mean of surface roughness of the tips.

6. A chemical mechanical polishing (CMP) apparatus, comprising:

a pad conditioning disk including a plurality of tip, a plurality of groove and diamond particles adhered to a surface of the plurality of tip and a surface of the plurality of groove; and a sacrificial pad controlling a surface roughness of the diamond particles, wherein a surface roughness of the diamond particles deposited on the surfaces of the plurality of tips differ from a surface roughness of the diamond particles deposited on the surfaces of the plurality of the grooves.

7. The apparatus of claim 6, wherein the surface roughness of the diamond particles is controlled to be no greater than about 1.5 μm.

8. The apparatus of claim 6, wherein the sacrificial pad includes a polyurethane pad.

9. The apparatus of claim 6, further comprising:

a polishing pad configured to be abraded by the diamond particles; and a polishing head configured to fix and rotate a wafer, wherein the wafer is configured to be mechanically abraded by contact with the polishing pad.

10. The apparatus of claim 9, wherein the pad conditioning disk is driven by a conditioning holder, which is movable and rotatable in a vertical direction, and the polishing pad is rotatable in an opposite direction to the rotating direction of the pad conditioning disk by a polishing turntable and is conditioned by the diamond particles.

11. The apparatus of claim 10, wherein the sacrificial pad is mounted on a disk conditioning turntable, and a rotating speed of the disk conditioning turntable is no less than that of the polishing turntable.

12. The apparatus of claim 10, wherein a downward pressure of the pad conditioning disk with respect to the sacrificial pad is no less than that of the pad conditioning disk with respect to the polishing pad.

13. The apparatus of claim 9, further comprising:

a pad slurry supply unit configured to supply a pad slurry on the polishing pad; and a disk slurry supply unit configured to supply a disk slurry on the sacrificial pad, wherein a concentration and size of abrasive particles of the disk slurry are no less than those of abrasive particles of the pad slurry.

14. The apparatus of claim 13, wherein the pad slurry includes an abrasive particles including at least one of silica, alumina, and ceria.

15. The method of claim 14, wherein the pad slurry further includes an oxidizing agent, a hydroxidizing agent, a surfactant and a dispersing agent.

16. A chemical mechanical polishing (CMP) apparatus, comprising:

a polishing head configured to hold and rotate a wafer;

a polishing station for polishing the wafer, the polishing station comprising: a polishing turntable which is rotatable, a polishing pad mounted on a top surface of the polishing turntable, the polishing pad configured to planarize the wafer by mechanical abrasion when in contact therewith;

a pad conditioner unit for cutting or abrading a surface of the polishing pad, the pad conditioner unit including:

a pad conditioning holder movable in a vertical direction and rotatable, and a pad conditioning disk including a base adhered to the pad conditioning holder, the base including mountain-type tips having inclined sidewalls and projecting from the base and valley-type grooves depressed between the tips, wherein the tips and grooves are repeatedly arranged and connected to each other, and a cutting layer formed on the base, the cutting layer including conditioning particles adhered to a surface of the tips and the grooves, and wherein at least some of the conditioning particles have differing surface heights from one another, a first slurry supply unit configured to supply a pad slurry including abrasive particles composed of at least one of silica, alumina, and ceria to a top surface of the polishing pad during at least one of the wafer polishing process or a pad conditioning process; and a pre-conditioner unit for pre-processing the pad conditioning disk, the pre-conditioner unit including: a disk conditioning turntable which is rotatable, a sacrificial pad mounted on a top surface of the disk conditioning turntable, and a second slurry supply unit configured to supply a disk slurry including abrasive particles composed of at least one of silica, alumina, and ceria on the sacrificial pad.

17. The method of claim 16, wherein the conditioning particles include one of diamond particles or sapphire particles.

18. The method of claim 17, wherein the diamond particles includes one of natural diamonds or artificial diamonds.

19. The method of claim 16, wherein a concentration of the abrasive particles of the disk slurry is in a range from about 5 to about 30 wt % of the disk slurry and a size of the abrasive particles is within a range of about 20 nm to about 400 nm.

20. The method of claim 16, wherein the base is formed of one of a ceramic or silicon material, the grooves are arranged in one of a mesh or lattice type extending in one of a vertical or horizontal direction, the tips defined by the grooves are formed in one of a pillar or mesa type having a lower cross-section smaller than an upper cross-section, and wherein the conditioning particles adhered to the surfaces of the tips have a surface roughness less than a surface roughness of the conditioning particles adhered to the surfaces of the grooves.

* * * * *